US006362707B1

(12) United States Patent
Reinhardt

(10) Patent No.: US 6,362,707 B1
(45) Date of Patent: Mar. 26, 2002

(54) EASILY TUNABLE DIELECTRICALLY LOADED RESONATORS

(75) Inventor: Victor S. Reinhardt, Rancho Palos Verdes, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/489,581

(22) Filed: Jan. 21, 2000

(51) Int. Cl.[7] ..... H01P 7/10; H01P 1/20; H01P 7/04

(52) U.S. Cl. ..... 333/219.1; 333/202; 333/207; 333/222; 333/223

(58) Field of Search ..... 333/202, 206, 333/207, 219.1, 222, 223

(56) References Cited

U.S. PATENT DOCUMENTS 4,307,357 A * 12/1981 Alm ..... 333/206
5,329,687 A * 7/1994 Scott et al. ..... 333/202
5,495,215 A * 2/1996 Newell et al. ..... 333/202
5,712,606 A * 1/1998 Sarkka ..... 333/219.1
5,777,534 A * 7/1998 Harrison ..... 333/202

* cited by examiner

*Primary Examiner*—Robert Pascal
*Assistant Examiner*—Patricia T. Nguyen
(74) *Attorney, Agent, or Firm*—Terje Gudmestad

(57) ABSTRACT

A multi-resonator filter, including a housing, at least one resonating element, at least one high dielectric constant element, at least one fine tuning screw located above the at least one resonating element and secured in a housing cover by a locking nut, housing screws to secure the housing cover to the housing. Where at least two resonating elements and at least two high dielectric constant elements are present, at least two slots are located in the at least two high dielectric constant elements to allow the easy installation and removal of at least one high dielectric coupling bridge used to increase the coupling between resonator sections, and at least one coupling probe.

18 Claims, 2 Drawing Sheets

EASILY TUNABLE DIELECTRICALLY LOADED RESONATORS

TECHNICAL FIELD

The present invention relates generally to filters and other devices utilizing dielectrically loaded resonators and more particularly to dielectrically loaded resonators with expanded tuning capabilities.

BACKGROUND ART

Resonators are commonly used in filters and other devices to receive and transmit electronic signals. Hollow metal resonators may be tuned to operate in a broad range of frequencies and bandwidths, however, their size and weight make them undesirable for use in many applications. It is known in the art that loading resonators with high dielectric constant ceramic materials can reduce the size and weight. The use of resonators with high dielectric constant ceramic materials can also reduce the size of filters by up to a factor of ten from the size of filters using hollow metal resonators. However, present dielectrically loaded resonators are limited in that they must be designed for a specific range of frequencies and bandwidths due to their limited tuning range.

In order to increase the range of frequencies and bandwidths in which these current resonators may be used, they may be subjected to tuning. Tuning present dielectrically loaded resonators beyond relatively minor adjustments, however, requires special manufacturing processes. These special manufacturing processes increase manufacturing schedules and the costs involved with manufacturing filters and other devices utilizing these resonators.

There are a variety of known configurations of dielectrically loaded resonator structures with three primary configurations. Some configurations require the resonators to be designed for a specific manufacturing use. Stocking multiple configurations for a broad range of applications is costly. Alternatively, modifying dielectric blanks for resonators or the filters that contain them involves relatively time consuming and expensive operations to achieve more than minor adjustment of their frequency range.

The first known example is composed of a high dielectric material plated on a metal resonator structure. This example does reduce the size and weight of the resonator, but it does so at the expense of tunability. Tuning of this configuration requires grinding the metal resonator structure to size and replating the high dielectric material coating. This is a difficult, costly and time-consuming process. The result is that resonators must be manufactured to tight tolerances and for specific applications. This not only effects the cost of the resonators but also increases the manufacturing schedule of the filter or other device in which the resonators will be used.

The second example consists of a shell made of a high dielectric material that surrounds a center metal resonator structure. This configuration is advantageous over the other known configurations since it allows for tuning of the resonator over a greater frequency range by machining the center post. Fine tuning is usually accomplished by electrical loading through the use of variable capacitors or external tuning stubs.

The final example, consists of un-plated dielectric resonators. These resonators rely on the high dielectric constant of the material to form a resonator. These resonators also have the disadvantage of a narrow tuning range. Although no plating is required, coarse tuning still requires a special manufacturing operation to regrind the ceramic dielectric material.

Conventional hollow metal resonators have the advantage of allowing the use of tuning screws for fine tuning. In dielectric resonators, such a tuning screw provides a much more limited tuning range because the E-M fields do not propagate very far beyond the high dielectric constant ceramic material.

Conventional hollow metal resonators are easily grouped together to form multiple resonator filters which use coupling probes and ports to carry the RI signal from one resonator to the other. The coupling ports can also be made adjustable through the use of tuning screws. In dielectric resonator filters, forming multiple resonator filters is much more difficult. Because the E-M fields do not propagate very far beyond the high dielectric constant material, setting the right coupling between resonators is very sensitive to dimensional tolerances. Also, connecting probes between inner posts requires drilled-out sections between the resonators and makes assembly difficult.

There is, therefore, a need for a resonator that utilizes the size and weight advantages of high dielectrically loaded resonators while retaining the broad range and ease of tuning and assembly characterized by hollow metal resonators.

SUMMARY OF THE INVENTION

It is therefore an object of the present invention to provide a resonator for use in filters and other devices that reduces the size and weight of the filters and provides easy tunability and for wide adjustability of the filters. It is a further object of the present invention to provide a multi-resonator filter with easily adjustable resonator couplings which reduces the schedule and cost of filter production.

In accordance with the objects of the present invention, an improved multi-resonator filter is provided. The multi-resonator filter contains resonators made up of a center metal resonator element surrounded by a high dielectric constant element. The high dielectric constant element is removable to allow easy tuning of the metal resonator element. Coarse tuning is accomplished by removing the high dielectric constant element and trimming the length of the center metal resonator element. After course tuning, the high dielectric constant element is replaced and affixed to the metal resonator element to keep the filter stable under vibration. The resonator also contains a fine tuning screw seated above the metal resonator element. The fine tuning screw can be turned to adjust the tuning of the metal resonator element. The high dielectric constant element extends above the metal resonator element to surround the fine tuning screw. By surrounding the fine tuning screw with the high dielectric constant element, the fine tuning range of the resonator is increased because the E-M field propagates up through the extended dielectric material.

The high dielectric constant elements contain slots in their sides to allow removable high dielectric coupling bridges to connect resonator sections within the multi-resonator filter. These high dielectric bridges increase the coupling between dielectrically loaded resistors to provide high dielectric constant paths for the E-M field between resonators. The high dielectric coupling bridges are easily removable to allow adjustment of the resonator couplings. High dielectric coupling bridges may be removed and adjusted or replaced to change the coupling between resonator sections. After adjustment of the coupling between resonator sections, the removable high dielectric coupling bridges are affixed to the dielectrically loaded resonators to keep the filter stable under vibration.

Other objects and features of the present invention will become apparent when viewed in light of the detailed description of the preferred embodiment when taken in conjunction with the attached drawings and appended claims.

DESCRIPTION OF THE PREFERRED EMBODIMENTS

Figure 1:
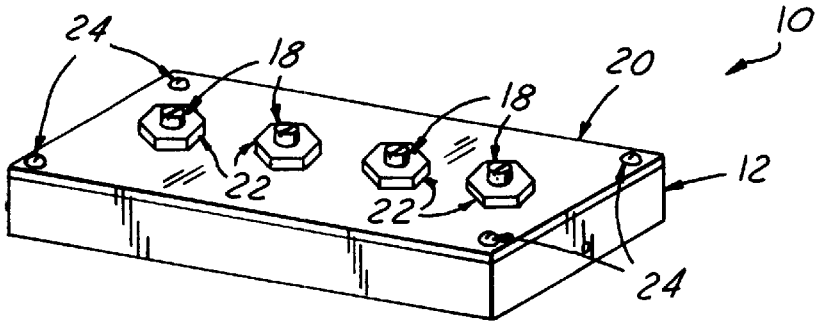
FIG. 1 is a perspective view of a multi-resonator filter in accordance with the preferred embodiment of the present invention.

Referring now to FIG. 1, which is a schematic view of a multi-resonator filter 10 in accordance with the present invention. The multi-resonator filter 10 is preferably for use in flight receivers. However, the multi-resonator filter 10 maybe used in a variety of other applications such as near object detection units and other automotive applications.

Figure 2:
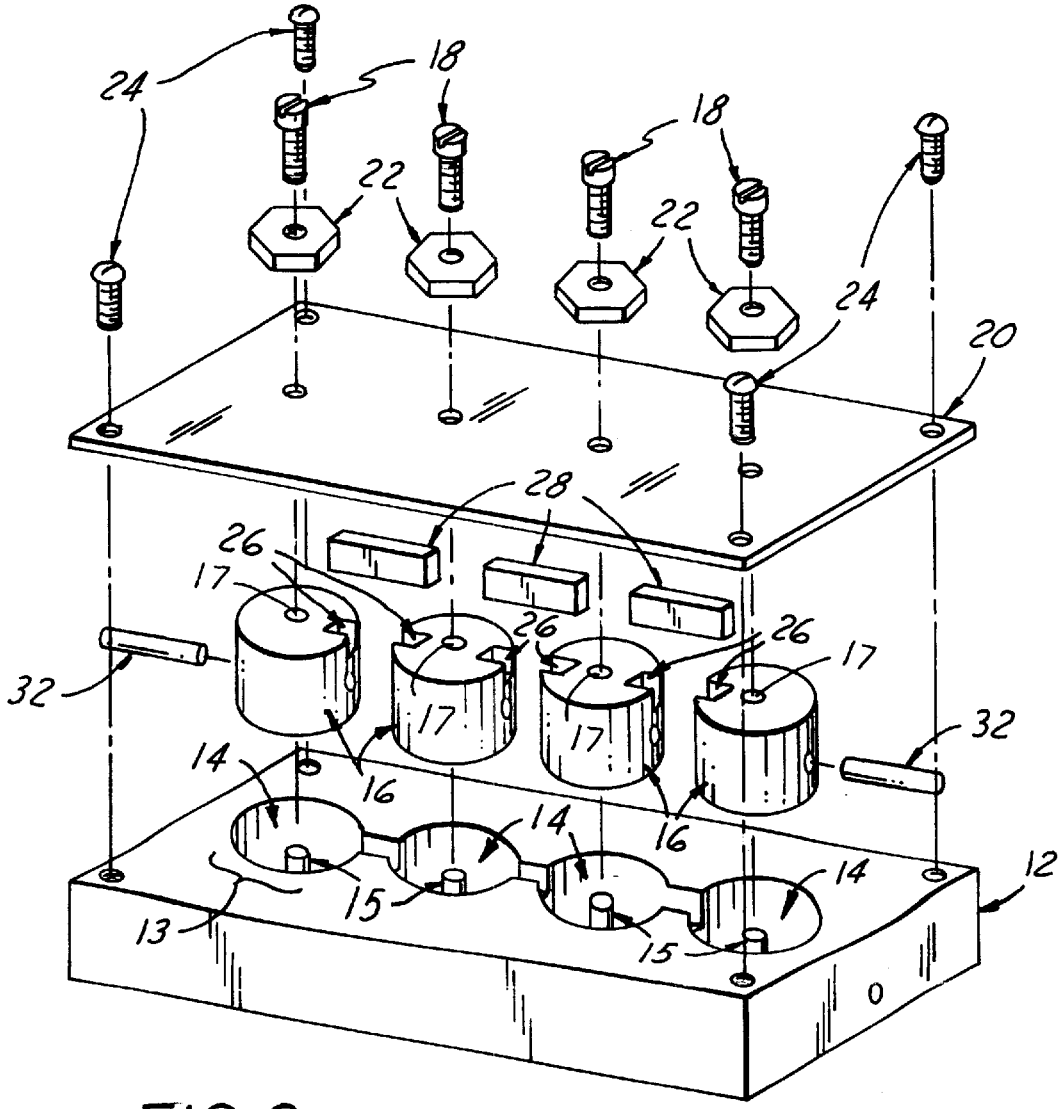
FIG. 2 is a exploded schematic view of the multi-resonator filter illustrated in FIG. 1.

Referring now to FIG. 2, which is an exploded schematic view of the multi-resonator filter 10 in accordance with the present invention. The multi-resonator filter 10 includes a housing 12 containing a plurality of metal coaxial resonating elements 13 which consist of resonator bores 14 with center posts 15 that are machined into the housing 12. Drop-in cylindrical high dielectric constant elements 16 with axial bores 17 drop into the resonator bores 14 to dielectrically load the metal coaxial resonating elements 13. One such material used in these drop-in high dielectric constant elements 16 is an unplated high dielectric constant material such as barium titinate ceramic. The use of a high dielectric ceramic material is known in the art to reduce the size and weight of a resonator. The use of high dielectric material in the fabrication of high Q filters and resonators is known to reduce the size of the filters by as much as a factor of 10. High Q comb-line filters are often used in flight receivers. The use of high dielectric material in the fabrication of these filters can reduce the size of these receivers by as much as a factor of 10 and can reduce weight similarly.

The drop-in high dielectric constant elements 16 are easily removed from the metal coaxial resonating elements 13 to allow coarse tuning of the combined resonator structure. After removing the drop-in high dielectric constant elements 16, coarse tuning can be performed on the metal coaxial resonating elements 13 by machining the center posts 15. This eliminates the need for grinding or plating the high dielectric constant elements 16. After coarse tuning is accomplished, the high dielectric constant elements 16 are reinserted and affixed to the metal coaxial resonating elements 13 to keep the resonator stable under vibration. One method of affixing the high dielectric elements 16 to the metal coaxial resonating elements 13 is through the use of an adhesive material. By only affixing the high dielectric constant elements 16 after coarse tuning, the tuning of the resonator may cheaply and easily be adjusted over a larger range than conventional high dielectric resonators without the need to grind or replate the high dielectric elements 16.

Figure 3:
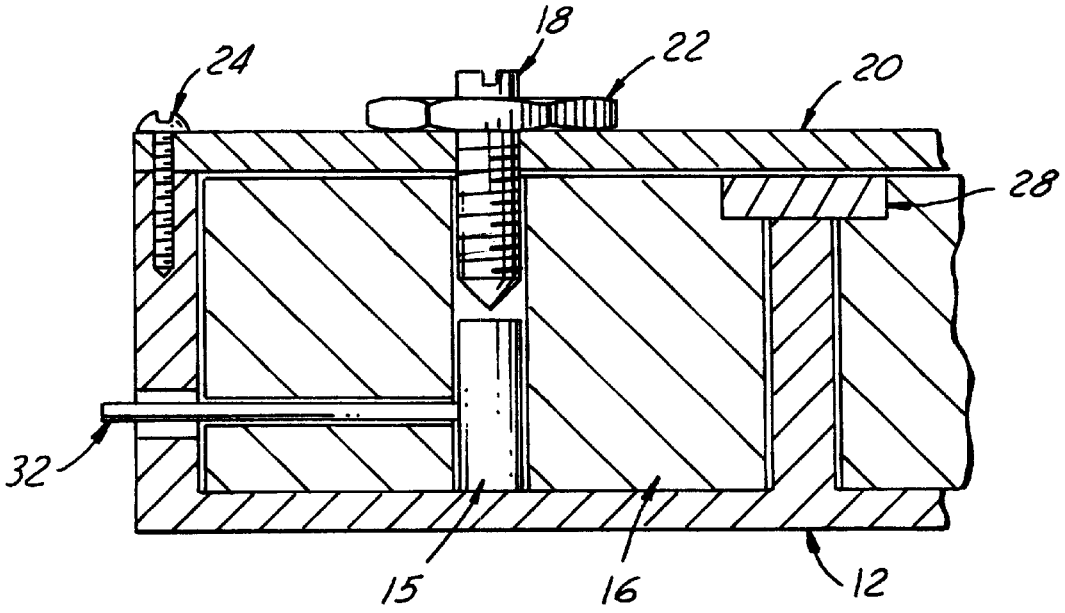
FIG. 3 is a cross-sectional view of the multi-resonator filter illustrated in FIG. 1, the cross-section being taken along the line 3—3 in FIG. 1 in the direction of the arrows.

In addition to the improvements relating to coarse tuning, the present invention also contains improvements relating to fine tuning. The high dielectric constant elements 16 extend beyond the top of the center posts 15 to surround fine tuning screws 18 (best viewed in FIG. 3). The fine tuning screws 18 are located above the center posts 15. The fine tuning screws 18 are supported by housing cover 20 and held in place by locking nut 22. The housing cover 20 is secured to the housing 12. One method of securing the housing cover 20 to the housing 12 is through the use of housing screws 24. Fine-tuning is accomplished by moving the fine tuning screws 18 up and down above the center posts 15. Fine tuning is accomplished by effecting the RF E-M field of the resonator. By extending the high dielectric constant element 16 to surround the fine tuning screws 18, the RF E-M field can be modified to a larger range of values by movement of the fine tuning screws 18. This increases the fine tuning range of the resonator.

The high dielectric constant elements 16 are formed with slots 26 located in their outer surface. These slots 26 are shaped to allow high dielectric coupling bridges 28 to be easily inserted between resonator sections within the filter. These high dielectric coupling bridges 28 provide high dielectric constant paths for the E-M field between resonators, increasing the coupling between resonators. The use of high dielectric coupling bridges 28 allows for greater coupling between resonators than is provided by the known practice of using the multi-resonator filter wall to increase coupling between resistors. The high dielectric coupling bridges 28 are drop in and removable to allow for simple tuning and adjustment of the coupling between resonators in the multi-resonator filter 10. The couplings can be adjusted by removing and trimming the high dielectric coupling bridges 28. By removing the high dielectric coupling bridges 28 for adjusting, each coupling may be adjusted separately. The easy adjustability of the resonator couplings allows the prestocking of a generic filter housing 12 and dielectric elements 16. Such prestocking further reduces the schedules and costs associated with filter design and production. After adjustment, the high dielectric coupling bridges 28 are affixed to the resonators to keep the multi-resonator filter 10 stable under vibration. One embodiment uses an adhesive material to affix the high dielectric coupling bridges 28 to the resonators.

Figure 4:
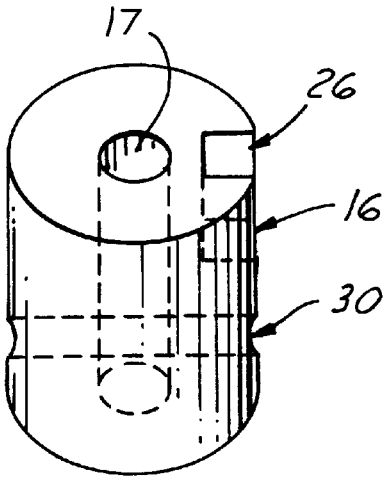
FIG. 4 is an illustration of a drop-in high dielectric constant element for use on the end of a multi-resonator filter in accordance with a preferred embodiment of the present invention.
Figure 5:
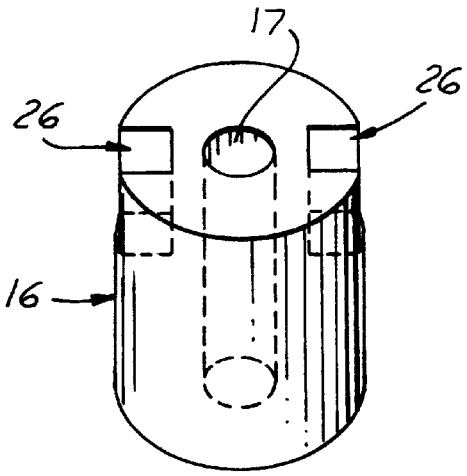
FIG. 5 is an illustration of a drop in high dielectric constant element for use in the center of a multi-resonator filter in accordance with a preferred embodiment of the present invention.

The high dielectric constant elements 16 located on each end of the multi-resonator filter 10 are formed with cutouts 30 to fit coupling probes 32. These coupling probes 32 are used in the multi-resonator filter 10 to provide coupling to coaxial input and output connectors such as SMA connectors known in established art. High dielectric constant elements 16 for the end resonators of a multi-resonator filter 10 are formed with a single cutout 30 for a coupling probe 32 and a single slot 26 for a high dielectric coupling bridge 28 (see FIG. 4). This allows the end dielectric elements 16 to be easily inserted and removed over the coupling probes 32 for easy coarse tuning of the end resonator. High dielectric constant elements 16 for the center resonators of a multi resonator filter 10 are formed with two slots 26 for high dielectric coupling bridges 28 and no cutout for a coupling probe 32 (see FIG. 5).

While particular embodiments of the invention have been shown and described, numerous variations and alternate embodiments will occur to those skilled in the art. Accordingly, it is intended that the invention be limited only in terms of the appended claims.

What is claimed is:

1. A resonator comprising:

a housing;

a resonating element having a center post; and a high dielectric constant element having an axial bore, said high dielectric constant element inserted into said resonating element by positioning said center post within said axial bore, and said high dielectric constant element removable from said resonating element to allow for tuning of said resonating element.

2. A resonator as recited in claim 1, wherein said resonating element further comprises:

a resonator bore in said housing.

3. A resonator as recited in claim 1, further comprising a fine tuning screw.

4. A resonator as recited in claim 1, further comprising a fine tuning screw, wherein said high dielectric constant element surrounds said fine tuning screw.

5. A resonator as recited in claim 1, where in said high dielectric constant element is composed of a ceramic material.

6. A resonator as recited in claim 1, wherein said high dielectric constant element is cylindrical in shape; and wherein said center post is cylindrical in shape.

7. A resonator as recited in claim 1, wherein said high dielectric constant element is bonded to said resonating element with adhesive material after tuning.

8. A resonator as recited in claim 1, wherein said resonator is part of a multi-resonator filter.

9. A multi-resonator filter comprising a housing;

at least two at least two resonating elements;

at least two high dielectric constant elements each paired with one of said at least two resonating elements to form at least two resonator sections;

at least one removable high dielectric coupling bridge which is removable to allow adjustment of the coupling between said at least two resonator sections; and wherein said removable high dielectric coupling bridge provides a high dielectric constant path for the E-M field between said at least two resonator sections.

10. A multi-resonator filter as recited in claim 9, wherein said at least two high dielectric constant elements contain slots to allow the easy addition and removal of said at least one removable high dielectric coupling bridge.

11. A multi-resonator filter as recited in claim 9, wherein said at least one removable high dielectric coupling bridge is affixed with adhesive material after adjustment of the coupling between said at least two resonator sections.

12. A multi-resonator filter as recited in claim 9, further comprising at least one coupling probe.

13. A multi-resonator filter as recited in claim 9, wherein said coupling between said at least two resonator sections is adjusted by removing and trimming said at least one high dielectric coupling bridge.

14. A multi-resonator filter as recited in claim 9, further comprising at least two coupling probes;

wherein each of said at least two high dielectric constant elements located on the opposing ends of the multi-resonator filter contain a cutout to allow said at least two coupling probes to pass through each of said at least two high dielectric constant elements located on the opposing ends of the multi-resonator filter to connect with each of said at least two resonating elements located on the opposing ends of the multi-resonator filter.

15. A method of tuning a resonator section, comprised of a high dielectric constant element and a resonating element, comprising the steps of:

removing the high dielectric constant element from the resonator section;

trimming the length of the resonating element to tune the resonator section;

replacing the high dielectric constant element; and affixing the high dielectric constant element to the resonating element to prevent vibration.

16. A method of tuning a resonator section, comprised of a high dielectric constant element, a resonating element, and a fine tuning screw, comprising the steps of:

removing the high dielectric constant element from the resonator section;

trimming the length of the resonating element to coarse tune the resonator section;

replacing the high dielectric constant element;

affixing the high dielectric constant element to the resonating element to prevent vibration; and fine tuning the resonator section by rotating the fine tuning screw to adjust the tuning of the resonator section.

17. A method for tuning a multi-resonator filter, comprised of at least one high dielectric coupling bridge and at least two resonator sections each containing a high dielectric constant element, a resonating element, and a fine tuning screw, comprising the steps of;

tuning each resonator section comprising the steps of;

removing the high dielectric constant element from the resonator section;

trimming the length of the resonating element to coarse tune the resonator section;

replacing the high dielectric constant element;

affixing the high dielectric constant element to the resonating element to prevent vibration;

fine tuning the resonator section by rotating the fine tuning screw to adjust the tuning of the resonator section;

tuning the coupling between resonator sections comprising the steps of:

removing the at least one high dielectric coupling bridge;

trimming the shape of the at least one high dielectric coupling bridge to adjust the coupling between individual resonator sections;

replacing the high dielectric coupling bridge;

affixing the high dielectric coupling bridge to the resonator sections to prevent vibration.

18. A resonator as recited in claim 1 further comprising:

a fine tuning screw positioned above said center post, said high dielectric constant element extending above said center post to surround said fine tuning screw.

* * * * *